United States Patent [19]

Wise

[11] 4,081,935

[45] Apr. 4, 1978

[54] BUILDING STRUCTURE UTILIZING PRECAST CONCRETE ELEMENTS

[75] Inventor: Harry Honon Wise, Belle Meade, N.J.

[73] Assignee: Johns-Manville Corporation, Denver, Colo.

[21] Appl. No.: 793,972

[22] Filed: May 5, 1977

Related U.S. Application Data

[63] Continuation-in-part of Ser. No. 708,504, Jul. 26, 1976, abandoned.

[51] Int. Cl.[2] ..... E04B 5/16

[52] U.S. Cl. ..... 52/236.8; 52/236.9; 52/252; 52/432; 52/726; 52/741

[58] Field of Search ..... 52/236.8, 236.9, 252, 52/432, 726, 741

[56] References Cited

U.S. PATENT DOCUMENTS

| | | | |
|---|---|---|---|
| 938,458 | 11/1909 | Brockhausen | 52/723 |
| 1,031,043 | 7/1912 | Conzelman | 52/583 X |
| 1,031,048 | 7/1912 | Conzelman | 52/432 X |
| 1,380,324 | 5/1921 | Piggins | 52/283 |

FOREIGN PATENT DOCUMENTS

| | | | |
|---|---|---|---|
| 376,308 | 7/1932 | United Kingdom | 52/432 |
| 591,431 | 8/1947 | United Kingdom | 52/722 |

*Primary Examiner*—Alfred C. Perham
*Attorney, Agent, or Firm*—Robert M. Krone; Joseph J. Kelly; James W. McClain

[57] ABSTRACT

A building structure is disclosed in which precast columns and beam and deck members are used. Upper columns are supported in spaced apart relationship to lower columns by pairs of rods extending from each column respectively and clamped together by clamping means. Topping concrete is poured to lock the members together into a unitary structure. The structure provides for self-leveling of the columns.

18 Claims, 7 Drawing Figures

BUILDING STRUCTURE UTILIZING PRECAST CONCRETE ELEMENTS

CROSS-REFERENCE TO RELATED APPLICATION

This application is a continuation-in-part of copending application Ser. No. 708,504, filed July 26, 1976 now abandoned.

BACKGROUND OF THE INVENTION

The invention herein relates to building structures utilizing precast concrete elements. More particularly, it relates to a building structure utilizing precast concrete columns, beams and decks which can be integrated into a unitary structure with a single topping layer of poured concrete.

In the past it has been difficult to integrate precast concrete columns into a building structure. Commonly, a floor of a building has been formed by emplacing columns on a base below (such as the ground or a lower floor), then erecting beams and deck plates supported by those columns. The floor is formed into a unitary structure by pouring a topping layer of concrete on top of the plates. Accommodation of columns to support the next higher floor has been made by leaving reinforcing rods protruding from the floor such that after the concrete hardens, the additional columns can be placed on top of the finished floor. Poured-in-place columns can be erected over the protruding reinforcing rods. Precast columns, however, are extremely difficult to integrate with the protruding rods. Further, except for contact with the rods, there is no integration of the additional columns with the underlying floor.

It has also been difficult in the past to insure that the upper columns were plumb and vertical. Careful measurement and extensive shoring have been required to establish the vertical alignment of the columns.

It would be advantageous to have a system wherein all columns were fully integrated with the floors both immediately above and below each column. It would also be advantageous to have a system wherein precast columns could be emplaced in the structure prior to finishing of each floor such that each precast column was readily and completely integrated with the floors above and below it. In addition, it would be advantageous to have a structure which provided simplified means of establishing vertical alignment of the columns.

BRIEF DESCRIPTION OF THE INVENTION

The invention herein is a unitary building floor structure comprising a supporting first percast concrete column having protruding from the upper end thereof at least one rod; at least one horizontal beam and deck member supported on said first column; a supported second precast concrete column disposed above said first column and having extending downwardly from the bottom thereof at least one rod; the rods extending respectively from said first and second columns being disposed in adjacent relationship and linked together by coupling means; said first and second columns being spaced apart a distance substantially equal to the depth of the finished floor and said beam and deck member; and a topping layer of concrete covering said beam and deck member and extending between said first and second columns to completely encase the extended portions of said rods and said coupling means; whereby said beam and deck member, topping layer of concrete and columns are secured into a unitary structure.

The invention also involves a method for the construction of buildings which comprises emplacing a first precast concrete column having protruding upwardly therefrom at least one rod; supporting from said column at least one horizontal beam and deck member; emplacing a second precast column having protruding downwardly therefrom at least one rod, said second column being positioned above said first column with said rods extending respectively from said first and second columns being positioned in adjacent relationship, and said columns being spaced apart by a distance substantially equal to the depth of the finished floor and said beam and deck member which is supported by said first column; connecting said adjacent rod with coupling means such that said second column is fixedly secured in said spaced apart position above said first column; and pouring a topping layer of concrete over said beam and deck member such that said concrete fills the space between said columns, whereby said columns, beam and deck member and topping layer of concrete are secured into a unitary structure.

DETAILED DESCRIPTION AND PREFERRED EMBODIMENTS

The invention herein is best understood by reference to the drawings.

Figure 1:
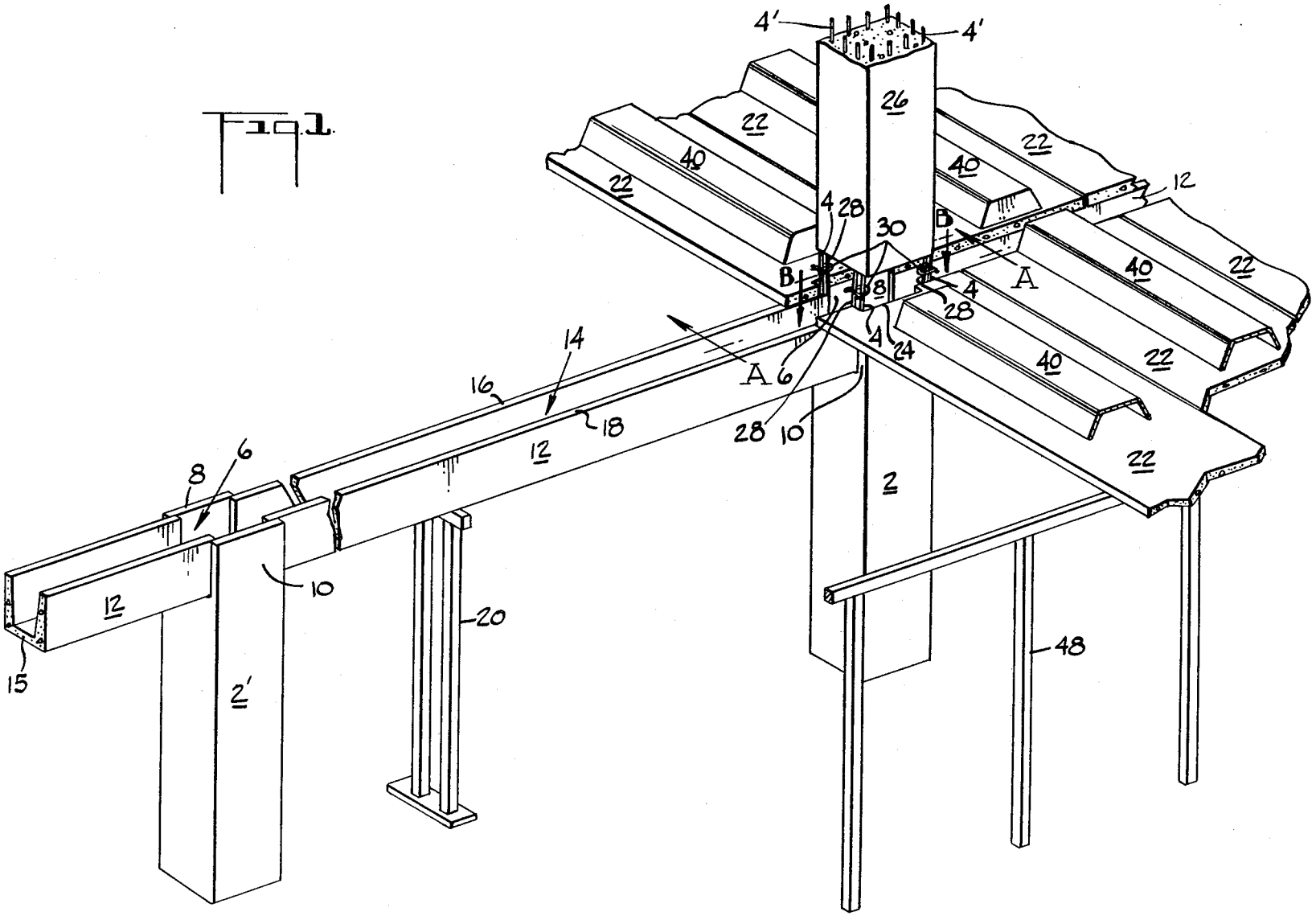
FIG. 1 is a partial perspective view illustrating generally the structure of the present invention prior to the pouring of the topping layer of concrete.

FIG. 1 shows an overall perspective view of a building structure incorporating the present invention. While only a single column-supported portion of the building structure is shown in FIG. 1, it will be understood that identical units will be repeated throughout the entire building.

The basic structure is supported by first precast concrete column 2. This column has extending upwardly therefrom at least one and preferably a plurality of rods 4, commonly steel reinforcing rods. The upper portion of column 2 is hollow and U-shaped as indicated at 6. The hollow is formed by upper portions 8 and 10 of the columns. This is best seen in FIG. 1 by reference to column 2', which is shown without rods 4 so that the upper structure of the column is more clearly visible.

Supported in the hollow portion of the column 2 is at least one horizontal beam 12. Except at corners of the floor, there will usually be at least two such beams 12 supported by a column 2 as shown. Preferably, the beam 12 is U-shaped having a hollow section 14 formed by the bottom of the beam 15 and the sidewalls 16 and 18. However, in another embodiment shown in FIG. 5, the beam (designated 12') is a solid beam having rods 50 protruding from the end thereof into hollow 6. When the topping layer 42 of concrete is later poured as described below, the rods 50 serve to lock in the beam 12 into the finished unitary structure. During construction, it is often desirable to have the horizontal beams 12 supported by shoring 20. The amount of shoring needed and its exact positioning will be readily determined by those skilled in the art. Once each floor is complete and the topping layer of concrete has hardened to form the floor into a unitary structure, the shoring 20 may be removed.

Supported on the upper edges of beams 12 are deck plates 22. These are typically precast concrete slabs with lengths up to 60 ft. or more, widths of 4 to 8 ft. or more and thickness of 2 or more inches. These are laid horizontally adjacent to one another with their terminal edges resting on the top edges of the beam 12. Where necessary for clearance of the columns, a portion may be cut out of the edge of a deck plate, as indicated at 24. Particularly suitable for this application are those precast concrete slabs sold by Johns-Manville Corporation under the trademark FILIGREE WIDESLAB.

In yet another embodiment (shown in FIGS. 6 and 7) beam 12 and deck plate 22 are combined into a unitary structure, which will be described below.

Figure 2:
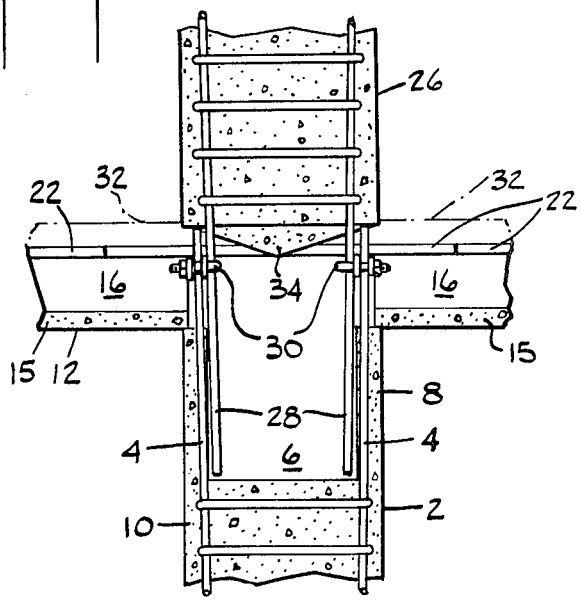
FIG. 2 is a modified sectional view taken on line A—A of FIG. 1, showing the structure of the present invention prior to pouring of the topping layer of concrete.
Figure 3:
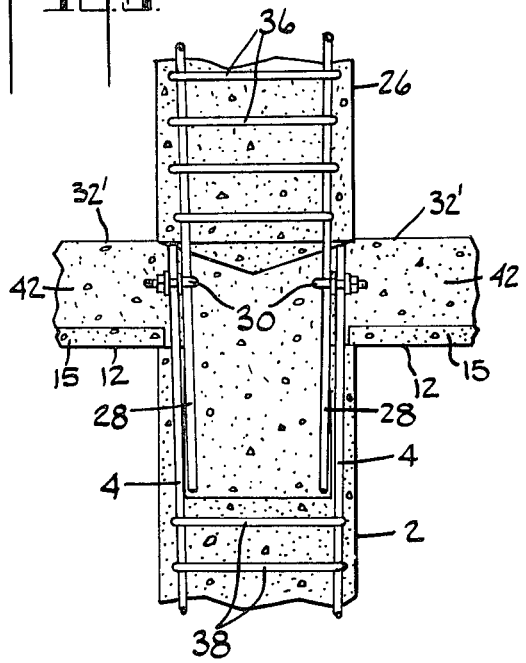
FIG. 3 is similar to FIG. 2, but shows the topping layer of concrete in place.
Figure 4:
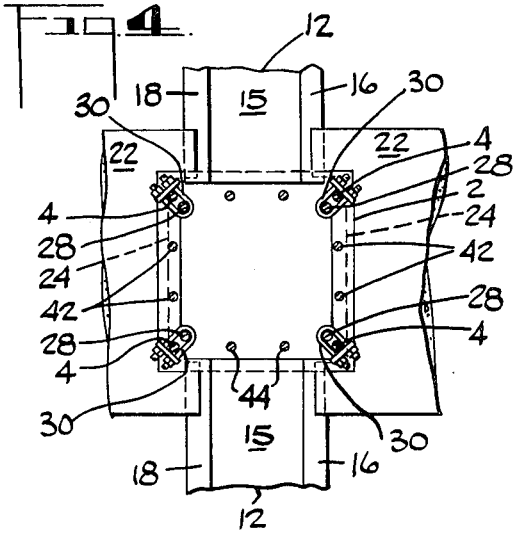
FIG. 4 is a plan view taken on line B—B of FIG. 1.

Disposed immediately above column 2 is second precast column 26. This column is usually structurally the same as column 2 and has extending downwardly therefrom at least one and preferably a plurality of rods 28. These rods are disposed adjacent to rods 4 extending upwardly from column 2, so that there is at least one pair of adjacent rods 4 and 28 and preferably a plurality of such pairs, as indicated in FIG. 4. The pairs of rods 4 and 28 are clamped together by coupling means 30, in this case illustrated by U-shaped shackles. The strength of the coupling between the two rods in each pair must be sufficient such that the entire weight of column 26 can be supported in a position suspended above column 2 as indicated in FIGS. 1 and 2. The spacing between columns 2 and 26 is indicated by the phantom line 32 in FIG. 2. This is the ultimate top level of the floor after the concrete topping layer has been poured; the complete poured floor to the same level is shown in FIG. 3 where the top surface is indicated at 32'.

In a preferred form, upper second column 26 has projecting downwardly therefrom a shallow, tapered portion 34 which will usually have a pyramidal or conical shape. This tapered portion permits easier flow of the topping layer of concrete under the column 26 and minimizes the formation of voids in the concrete in that area.

In a preferred embodiment (shown specifically in FIG. 7 but generally applicable to all versions of the invention) the tops of rods 4 which extend upward from column 2 are aligned or cut off level with one another, so that the tops of the rods 4 form a level plane. The second column 26 can then be rested on the tops of those rods 4 prior to its securement with coupling means 30, and the level plane formed by the rod tops will serve to level and plumb the second column 26, thus obviating the need for elaborate leveling procedures. This of course can be continued for rods 4' at the top of second column 26, thus facilitating leveling and plumbing of the columns throughout the entire height of the building.

It is also conventional with precast concrete columns to have inserted therein reinforcing ties throughout the column, such as indicated at 36 and 38. These ties will, of course, extend some distance into the columns and, in fact, may extend completely through the columns. Where the column, such as 26, is an intermediate column in the building structure, the protruding ties may extend entirely through the column and extend from both ends, thus representing rods 28 at the lower end and rods 4 at the upper end, as indicated by the rods 4' in FIG. 1.

After the beam 12 and deck plates 22 have been emplaced various structures such as void forms 40 may be mounted on the deck. In addition all necessary electrical and mechanical work can be put in place at this time. Alternatively, such void forms and/or mechanical or electrical work may have been partly or wholly installed at the plant where the deck plates 22 were made. During the same time second columns 26 are put in place and secured by coupling means 30 to lower columns 2. Once all mechanical and electrical work is completed on the deck created by beams 12 and deck plates 22, and the second columns 26 are in place, the final step in construction of the unitary floor can be undertaken. This step consists of the pouring of topping layer of concrete 42. This topping layer will flow across the deck created by deck plates 22 and fill the hollows 6 in column 2 and hollows 14 in beams 12. Sufficient concrete will be poured to fill the entire deck to a level indicated by 32' which is at or slightly above the lower end of columns 26. The concrete will of course completely surround and encase rods 4 and 28 and couplings 30. In addition, if desired for reinforcing purposes, additional rods 44 and 46 protruding respectively from columns 2 and 28 may extend into the concrete topping layer 42. Once the topping layer 42 has set, it will be evident that the entire structure of columns 2 and 26, beams 12, topping layer 42 and deck plates 22 are secured into single unitary monolithic structure.

As with shoring 20 for beams 12, it may be desirable during construction to support deck plates 22 with shoring such as that indicated at 48. Once the entire topping layer of concrete has been poured and set to form the unitary floor, shoring 48 may be removed. As with shoring 20, the amount and placing of shoring 48 will be well known by those skilled in the art.

Figure 5:
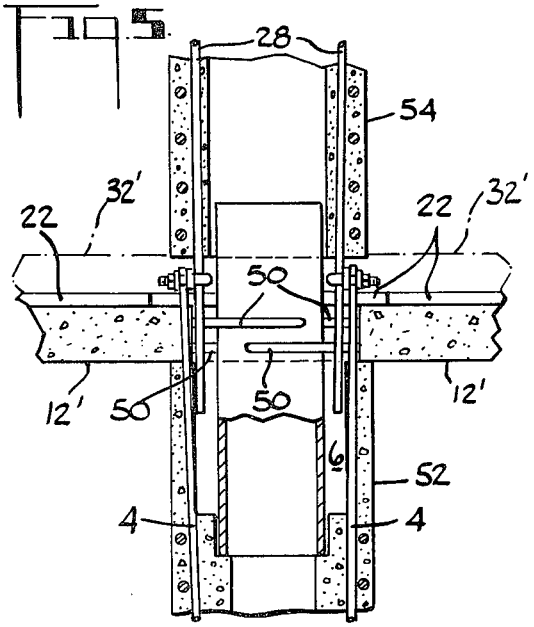
FIG. 5 is a view similar to FIG. 2, but illustrating another embodiment of the invention.

Another embodiment of the invention herein is illustrated in FIG. 5. In this embodiment beams 12' are solid with rods 50 protruding from them into space 6, as described above. In addition, hollow precast columns designated 52 and 54 are also shown. Precast hollow columns may be desirable when weight is a factor or when there is a need to run electrical or mechanical services through the columns. The hollow cores of the columns may be capped to keep the topping layer 42 of concrete out of them if desired, or a hollow sleeve such as 56 may be used to allow concrete to flow into hollow 6 but still provide continuous passageways for various services.

Figure 6:
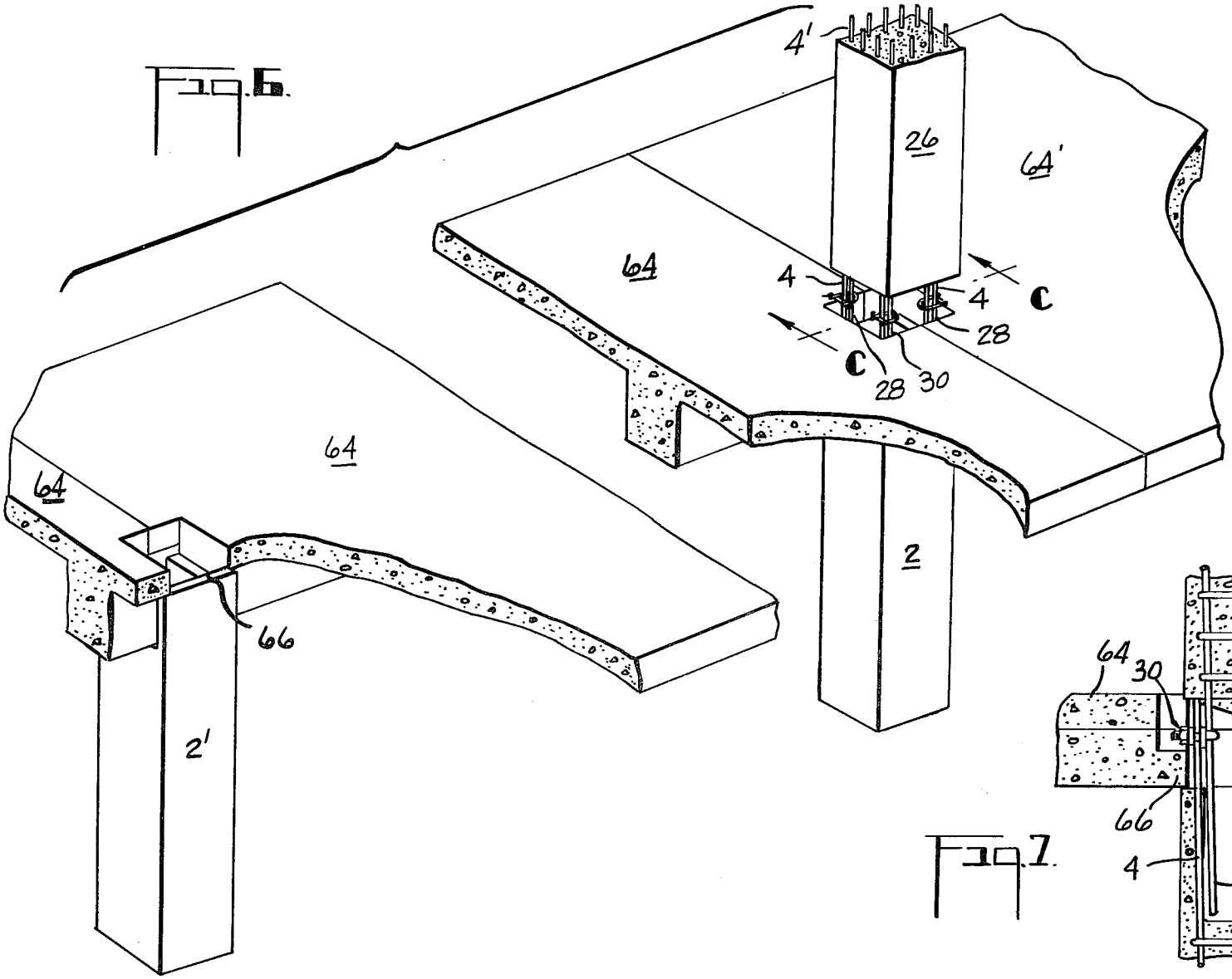
FIG. 6 is a perspective view similar to FIG. 1 and illustrating another embodiment of the invention.
Figure 7:
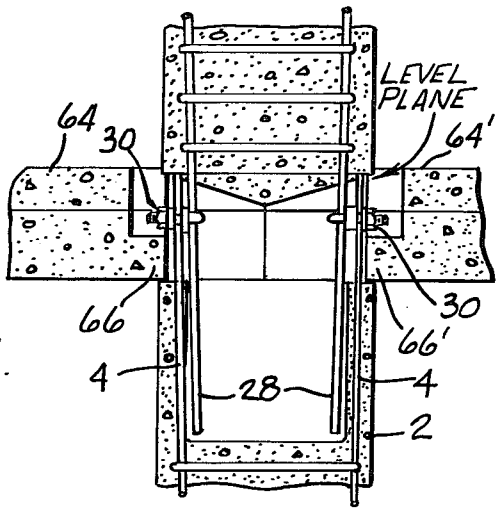
FIG. 7 is a cross-sectional view taken on line C—C of FIG. 6.

Another embodiment of the invention is shown in FIG. 6, in which beam 12 and deck plate 22 are combined into a unitary structure designated rib slab 64. Ribbed slab 64 is positioned to be supported by columns 2 and 2' and to abut similar ribbed slabs 64'. The slabs 64 and 64' will have shoulders 66 and 66' to accommodate the rods 4 and 28 and the bottom of column 26 or alternatively shoulders (not shown) can be incorporated into the top of columns 2 and 2' to support a shoulderless beam portion of slabs 64 and 64'.

The invention herein also comprises the method of forming the floor previously described. Ordinary placement means for columns 2, beams 12 and deck plates 22, or ribbed slabs 64, may be used. The placement of columns 26 will normally require cranes or other hoisting means to hold the column in position while coupling means 30 are installed and the entire rod structure secured. The preferred selfleveling function of the planar tops of rods 4 will of course facilitate this operation. Conventional concrete pouring means may be used to form the topping layer 42.

What is claimed is:

1. A building floor structure comprising:

(a) a supporting first precast concrete column having protruding from the upper end thereof at least one rod;

(b) at least one horizontal beam and deck member supported on said first column;

(c) a second precast concrete column disposed above said first column and having extending downwardly therefrom at least one rod;

(d) said first and second columns being spaced apart by a distance substantially equal to the desired depth of the finished floor and said beam and deck member;

(e) said rods extending from said first and second columns respectively being disposed in adjacent pairs, each pair comprising one rod from each column;

(f) said second column being held in said spaced apart position prior to pouring and setting of a topping concrete layer by coupling means fixedly securing together the rods of each of said pairs; and (g) a subsequently applied topping layer of concrete which fills the space between said columns, covers said beam and deck member, and secures these components into a unitary monolithic structure.

2. The flow structure of claim 1 wherein there are a plurality of said pairs of said rods, each pair being secured together by said coupling means.

3. The floor structure of claim 1 wherein said beam and deck member comprises a unitary member having a beam portion integral with a deck portion.

4. The floor structure of claim 3 wherein there are a plurality of said unitary members.

5. The floor structure of claim 1 wherein said beam and deck member comprises a separate horizontal beam and at least one separate deck plate supported by said beam.

6. The floor structure of claim 5 wherein said beam is U-shaped in cross-section.

7. The floor structure of claim 5 wherein said deck plate comprises a precast concrete slab.

8. The floor structure of claim 5 wherein there are a plurality of said beams and deck plates.

9. The floor structure of claim 1 wherein said second column has on the bottom thereof a tapered portion.

10. The floor structure of claim 1 wherein there are a plurality of rods protruding upwardly from the upper end of said first precast concrete column and the tops of said rods form a level horizontal plane upon which said second precast concrete column can be supported in a level and plumb disposition.

11. The floor structure of claim 1 wherein said first column has a hollow upper portion.

12. The floor structure of claim 8 wherein said topping layer of concrete fills the hollow portion of said first column.

13. The method of constructing a unitary building floor structure which comprises:

(a) emplacing a supporting first precast concrete column having protruding from the upper end thereof at least one rod;

(b) supporting at least one beam and deck member on said first column;

(c) emplacing above said first column a second precast concrete column having extending downwardly therefrom at least one rod, said second column being spaced apart from said first column by a distance substantially equal to the depth of the finished floor and said beam and deck member;

(d) aligning said rods extending from said first and second column so as to form pairs of adjacent rods, each pair containing one rod from each of said columns;

(e) securing said columns in said spaced apart position by clamping each of said pairs of rods with coupling means; and (f) thereafter pouring a topping layer of concrete over said beam and deck member and into the space between said column, such that when said topping layer of concrete sets all of these members are secured into a unitary monolithic structure.

14. The method of claim 13 wherein said beam and deck member comprises a unitary member having a beam portion and a deck portion.

15. The method of claim 13 wherein said beam and deck member comprises a separate horizontal beam and at least one separate deck plate supported by said beam.

16. The method of claim 15 wherein said beam has a U-shaped cross-section and said topping layer of concrete flows into the hollow formed by said U-shape.

17. The method of claim 13 wherein said second column has a tapered section at the bottom thereof to prevent the formation of voids in the concrete when said topping layer of concrete is poured into the space between said columns.

18. The method of claim 13 wherein there are a plurality of rods protruding from the upper end of said first precast concrete column and the tops of said rods form a level horizontal plane, supporting said second precast concrete column on said tops of said rods so as to position said second column in a level and plumb position, and thereafter securing said second column in said level and plumb position.

* * * * *